US005306071A

United States Patent [19]

Zamo' et al.

[11] Patent Number: 5,306,071

[45] Date of Patent: Apr. 26, 1994

[54] OBJECT HOLDER FOR OFFICE-TYPE CHAIRS

[75] Inventors: Lucio Zamo'; Nicola Zamo', both of Manzano; Silvano Guion, Udine; Giuseppe Todesco, Sacile, all of Italy

[73] Assignee: Offix Italia Srl, Gorizia, Italy

[21] Appl. No.: 893,837

[22] Filed: Jun. 4, 1992

[30] Foreign Application Priority Data

Jun. 10, 1991 [IT] Italy ..... UD91 U 000024

[51] Int. Cl.[5] ..... A47C 7/62

[52] U.S. Cl. ..... 297/192; 297/191; 297/194; 248/311.2

[58] Field of Search ..... 297/192, 191, 194, 188; 248/293, 311.2, 298

[56] References Cited

U.S. PATENT DOCUMENTS

| | | | |
|---|---|---|---|
| 1,375,573 | 4/1921 | Dennis . | |
| 1,907,322 | 5/1933 | Keicher | 297/194 X |
| 2,652,887 | 9/1953 | Fitzgerald | 297/192 X |
| 2,673,601 | 3/1954 | Fischer et al. | 297/192 X |
| 2,692,007 | 10/1954 | Christian . | |
| 2,765,025 | 10/1956 | Bakalic et al. | 297/192 X |
| 3,049,374 | 8/1962 | Nance . | |
| 3,180,680 | 4/1965 | Landvik . | |
| 3,245,090 | 4/1966 | Slimmer | 297/192 X |
| 3,321,237 | 5/1967 | Gangell | 297/192 X |
| 3,936,091 | 2/1976 | Rabinowitz | 297/188 |
| 4,061,395 | 12/1977 | Boole | 297/192 |
| 4,583,707 | 4/1986 | Anderson | 248/293 |
| 4,792,183 | 12/1988 | Townsend | 297/191 X |
| 4,887,379 | 12/1989 | Harrison | 297/192 X |
| 5,060,899 | 10/1991 | Lorence et al. | 248/311.2 |
| 5,100,198 | 3/1992 | Baltzell | 297/192 |

FOREIGN PATENT DOCUMENTS

| | | | |
|---|---|---|---|
| 112315 | 2/1964 | Czechoslovakia | 297/192 |
| 2006317 | 8/1971 | Fed. Rep. of Germany . | |
| 201914 | 3/1939 | Switzerland | 297/192 |
| 277439 | 9/1927 | United Kingdom | 297/194 |
| 334648 | 9/1930 | United Kingdom | 297/194 |
| 696872 | 9/1953 | United Kingdom . | |

*Primary Examiner*—Peter M. Cuomo
*Assistant Examiner*—Jerry Redman
*Attorney, Agent, or Firm*—Antonelli, Terry, Stout & Kraus

[57] ABSTRACT

Object holder for office-type chairs (13), which are used advantageously for children and/or youngsters and comprise a seat (15), a seatback (14) and a supporting base (20), at least one small object holder (10) being positioned in cooperation with a specific part (seat, seatback, arm) of the office-type chair (13) and having a retracted position (24*a*) within that specific part and a usage position (24*b*) at the side of and outside that specific part.

9 Claims, 3 Drawing Sheets

OBJECT HOLDER FOR OFFICE-TYPE CHAIRS

BACKGROUND OF THE INVENTION

This invention concerns an object holder for office-type chairs.

The object holder of this invention is applied advantageously, but not only, to office-type chairs and in particular to office-type chairs used by children or youngsters. The object holder according to the invention can be fitted to all kinds of office-type chairs used by children and/or youngsters and others and equipped, or not equipped, with arms. The present applicant is not aware of object holders fitted to office-type chairs for children and/or youngsters and capable of being applied to all kinds of chairs, whether office-type chairs or not, as set forth in this invention.

U.S. Pat. No. A-3,180,680 discloses a rack located below a foldable chair and acting as an object holder for the person occupying the chair or for anyone sitting in a chair behind the chair in question.

GB-A-696,872 discloses an easy chair with an object-holder drawer positioned below and capable of being pulled open together with one arm of the chair.

U.S. Pat. No. A-3,049,374 discloses a food container which can be positioned in cooperation with the seatback of an aircraft seat.

U.S. Pat. No. A-1,375,573 discloses jutting containers which are fitted in a stationary manner to the arm of an armchair.

The above teachings of the state of the art cannot be applied to office chairs or office-type chairs since they are structurally and functionally unsuitable for the purposes and use of office chairs.

SUMMARY OF THE INVENTION

The purpose of this invention is to provide normal office chairs, preferably for children, with a small object holder suitable to support and contain small objects without increasing the lateral bulk of the chair, except momentarily while the device is being used.

A person seated on the chair can have ready access to the object holder according to the invention.

According to the invention an office-type chair can be equipped with several object holders, which may also be different from each other.

The object holder according to the invention is fitted advantageously, but not only, to office-type chairs. It can be used also on chairs positioned in front of a desk and used by visitors, or in conference rooms, or lecture halls.

The object holder according to the invention also enables a desk to be kept free of all the small objects commonly used, which are rested otherwise on the desk and take up space and may sometimes cause confusion.

The object holder according to the invention enables small objects to be stored which belong to office work, such as pens, pencils, writing equipment in general, personal objects, etc., in a structure solidly fixed to the chair itself.

The object holder according to the invention comprises a container which can be moved from a closed position to an open position and which is fitted firmly to the seat of the chair below and at one side of the seat.

According to a variant the object holder is within an arm and protrudes sideways therefrom in an open position.

According to another variant the object holder is fitted in cooperation with the seatback of the office-type chair and protrudes sideways from the seatback in an open position.

According to yet another variant several object holders according to the invention can be fitted to the same chair.

According to still another variant the object holder according to the invention is equipped with a lid that can be overturned or can slide so as to prevent the objects stored in the object holder from falling when the chair is moved.

BRIEF DESCRIPTION OF THE DRAWINGS

The attached figures, which are given as a non-restrictive example, show some preferred embodiments of the invention as follows.

DETAILED DESCRIPTION OF THE PREFERRED EMBODIMENTS

Figure 1:
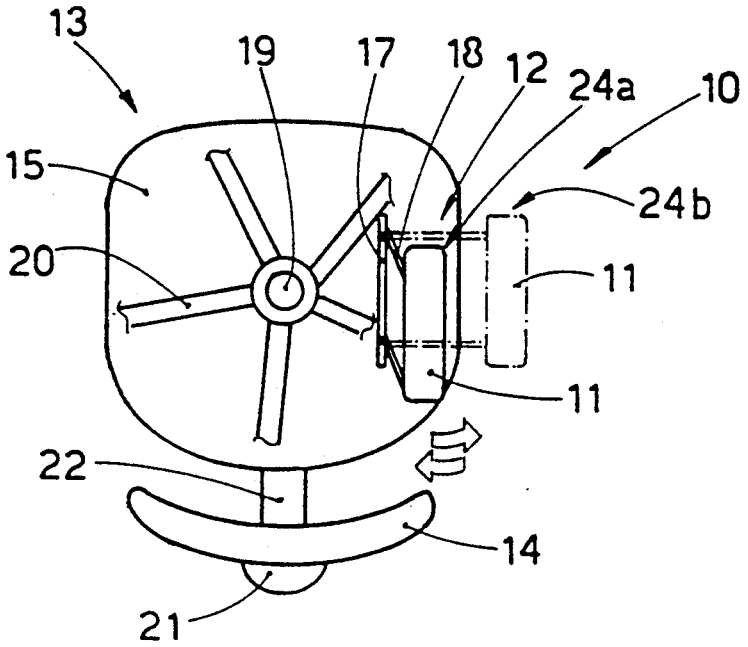
FIG. 1 shows from below an office-type chair equipped with an object holder according to the invention.

In the figures the reference number 10 indicates generally an object holder for office-type chairs used advantageously, but not only, by children and/or youngsters. In this case the object holder 10 according to the invention is fitted to a common office-type chair 13.

This office-type chair 13 is of a known kind and consists in particular of a supporting base 20, with or without wheels, to which is fitted a supporting shaft 19 that bears a seat 15 on its upper end.

To the seat 15 is fitted in this example a seatback support 22, on which is positioned a seatback 14 by means of a seatback adjustment device 21.

The object holder 10 according to the invention consists of a container 11 fitted below and to the side of the seat 15 by a positioner device 12, which enables the container 11 to be positioned at the side of the seat 15 so as to be accessible to a user seated on the office-type chair 13.

The container 11 according to the invention has a retracted position **24*a* contained within overall dimensions of the seat 15 and a usage position 24*b* outside the overall dimensions of the seat 15**.

In the attached figures the retracted position **24*a* is shown with continuous lines, whereas the usage position 24*b*** is shown with lines of dots and dashes.

Figure 2:
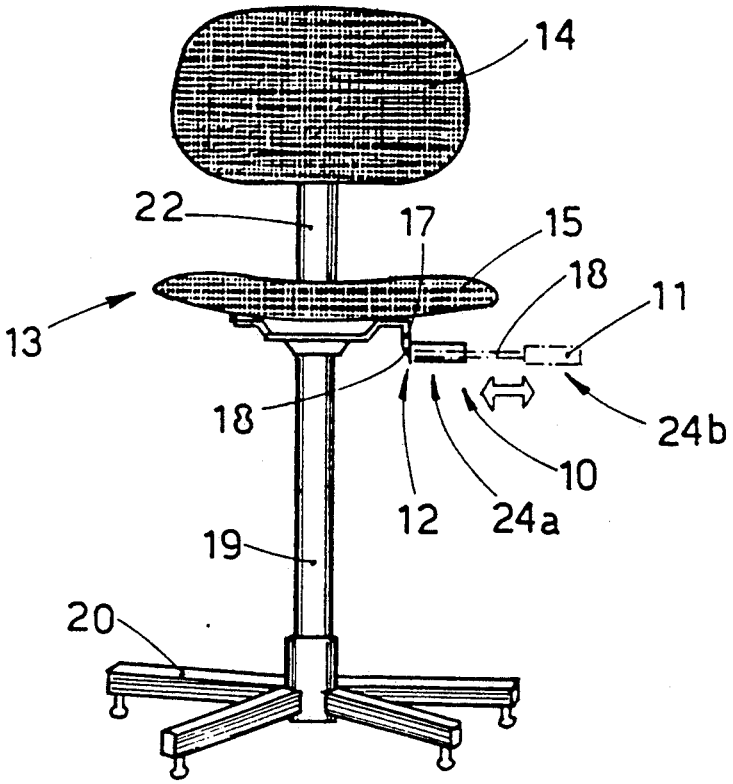
FIG. 2 is a front view of the chair of FIG. 1.

In FIGS. 1 and 2 the container 11 can move horizontally and is fitted to the ends of an articulated parallelogram consisting of positioner rods 18, the other ends of which are secured rotatably to a bracket 17 solidly installed on the lower surface of the seat 15.

According to a variant the object holders 10 are two in number and are fitted to the two sides of the seat 15.

According to another variant the object holder 10 according to the invention in chairs 13 equipped with arms 16 is fitted within the arm 16 and has its usage position **24*b* outside and sideways to the arm 16**.

Figure 4:
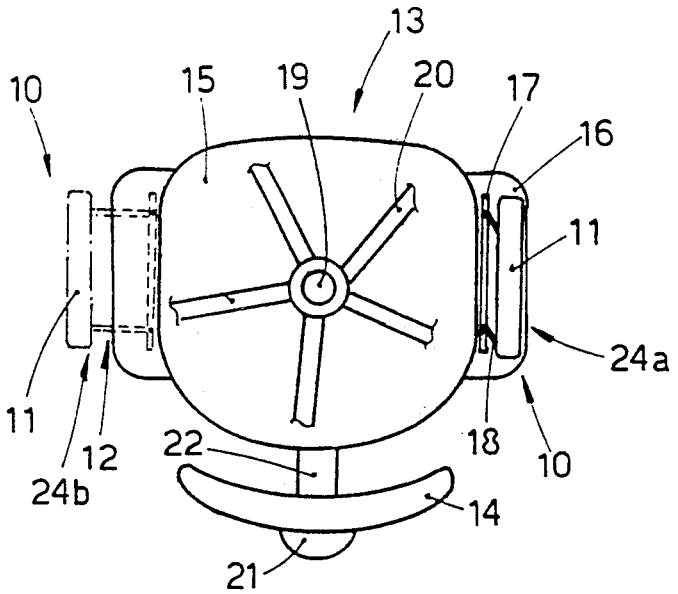
FIG. 4 shows from below an office-type chair with arms which is equipped with an object holder according to the invention.
Figure 5:
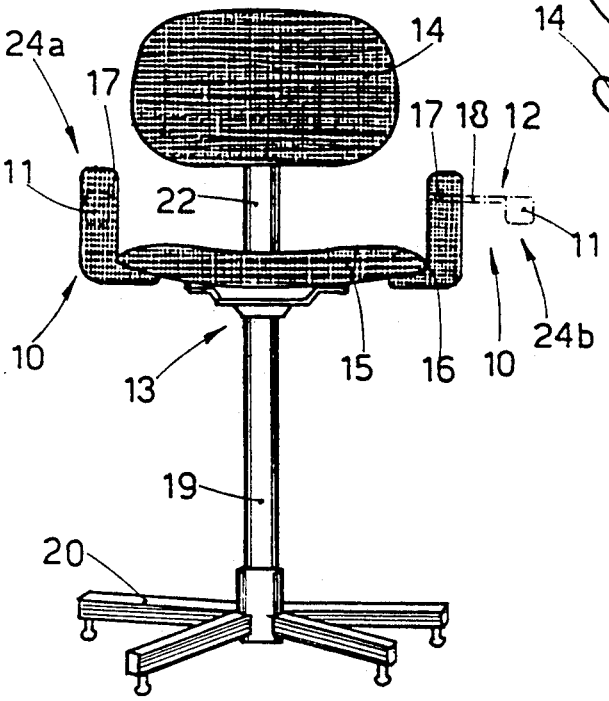
FIG. 5 is a front view of the chair of FIG. 4.

According to yet another variant (see FIGS. 4 and 5) the object holders 10 are two in number and are fitted to the two arms 16.

Figure 3:
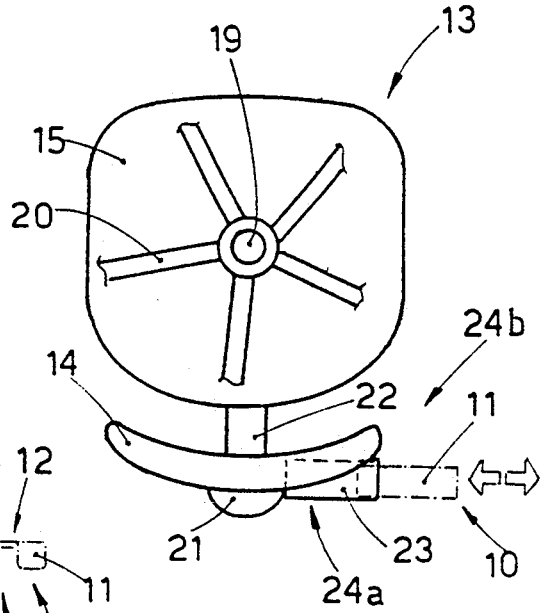
FIG. 3 shows from below a variant of FIG. 1.

According to a further variant the container 11 is positioned in a drawer 23 having a substantially horizontal axis and provided in the rear portion of the seatback 14 of the office-type chair 13 (see FIG. 3). According to this variant the container 11 takes up the retracted position 24*a* when it has been inserted into the drawer 23 whereas, when it has been withdrawn from the drawer 23, it takes up its usage position 24*b* at the side of the seatback 14.

According to still another variant, which is not shown here, the drawer 23 may be positioned in the lower portion of an arm 16, with the container 11 able to be extracted in a lengthwise direction or in a crosswise direction depending on the conformation of the drawer 23.

Figure 6A:
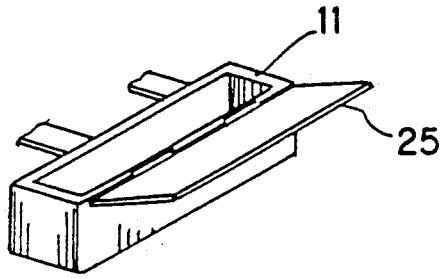
FIGS. 6A and 6B are perspective views showing the object holder equipped with a lid.
Figure 6B:
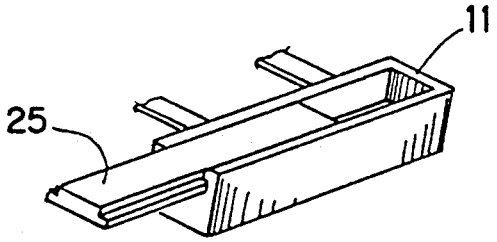

According to further variants shown in FIGS. 6A and 6B, the container 11 is equipped with a lid 25 which can be overturned (FIG. 6A) or can slide (FIG. 6B).

The chair 13 can be equipped with several object holders 10 according to the invention by any combination of the above variants.

We claim:

1. An office-type chair, comprising:

a support base;

a seat supported in a substantially horizontal plane by said supporting base, said seat having a front edge, an opposed rear edge and a pair of opposed said edges;

a seatback extending substantially vertically adjacent a rear edge of said seat and having a drawer in a rear portion thereof, said drawer having an object holder slidable along a substantially horizontal axis extending substantially perpendicular to said pair of opposed side edges of said seat; and said object holder having a retracted position within said drawer and a usage position withdrawn from said drawer and at a side of said seatback.

2. An office-type chair according to claim 1, wherein said object holder has a lid.

3. An office-type chair according to claim 1, wherein said supporting base, seat and seatback are dimensioned for use by a child.

4. An office-type chair having an object holder, comprising:

a supporting base;

a seat supported in a substantially horizontal plane by said supporting base, said seat having a front edge, an opposed rear edge and a pair of opposed said edges;

a seatback extending substantially vertically adjacent a rear edge of said seat; and an object holder movable substantially on a horizontal plane below said seat and having a retracted position below said seat and between said pair of opposed side edges and a usage positiion below and outside a perimeter of said seat adjacent one of said opposed side edges, said object holder being fitted to first ends of a pair of parallel spaced positioner rods, second ends of which are rotatably secured to a bracket provided below said seat, said bracket, said pair of parallel spaced positioner rods and said object holder forming an articulated parallelogram.

5. An office-type according to claim 4, wherein said object holder has a lid.

6. An office-type chair according to claim 4, wherein said supporting base, seat and seatback are dimensioned for use by a child.

7. An office-type chair having an object holder, comprising:

a supporting base;

a seat supported in a substantially horizontal plane by said supporting base, said seat having a front edge, an opposed rear edge and a pair of opposed said edges;

a seatback extending substantially vertically adjacent a rear edge of said seat;

at least one arm having a top surface extending substantially parallel to one of said opposed side edges of said seat; and an object holder movable substantially on a horizontal plane and having a retracted position adjacent said arm nd a usage position away from said arm, said object holder being fitted to first ends of a pair of parallel spaced positioner rods, second ends of which are rotatably secured to a bracket provided adjacent said arm, said bracket, said pair of parallel spaced positioner rods and said object holder forming an articulated parallelogram.

8. An office-type chair according to claim 1, wherein said object holder has a lid.

9. An office-type chair according to claim 7, wherein said supporting base, seat, seatback and at least one arm are dimensioned for use by a child.

* * * * *